US012729495B2

(12) United States Patent
Hughes, Jr.

(10) Patent No.: US 12,729,495 B2
(45) Date of Patent: Sep. 8, 2026

(54) SAFE ZONE POST ASSEMBLY

(71) Applicant: Robert K Hughes, Jr., Cape Coral, FL (US)

(72) Inventor: Robert K Hughes, Jr., Cape Coral, FL (US)

( * ) Notice: Subject to any disclaimer, the term of this patent is extended or adjusted under 35 U.S.C. 154(b) by 405 days.

(21) Appl. No.: 18/538,779

(22) Filed: Dec. 13, 2023

(65) Prior Publication Data

US 2024/0229383 A1 Jul. 11, 2024

Related U.S. Application Data

(60) Provisional application No. 63/438,299, filed on Jan. 11, 2023.

(51) Int. Cl.
*E01F 9/681* (2016.01)
*E01F 9/627* (2016.01)

(52) U.S. Cl.
CPC ..... *E01F 9/681* (2016.02); *E01F 9/627* (2016.02)

(58) Field of Classification Search
CPC ... E01F 9/60; E01F 9/602; E01F 9/627; E01F 9/635; E01F 9/681
USPC ..... 40/607.1, 607.04, 607.06; 404/7, 10
See application file for complete search history.

(56) References Cited

U.S. PATENT DOCUMENTS 2,025,004 A * 12/1935 Shearer ..... G09F 7/18 40/607.1
4,004,545 A 1/1977 O'Donnell
4,298,292 A 11/1981 Sweeney
4,596,489 A 6/1986 Mariol et al.
4,691,818 A 9/1987 Weber
4,862,823 A 9/1989 Hughes
4,903,465 A 2/1990 Hughes
4,908,249 A * 3/1990 Lines ..... E01F 9/608 40/607.1
5,040,478 A 8/1991 Hughes
5,104,256 A 4/1992 D'Avela
5,197,819 A 3/1993 Hughes
5,205,236 A 4/1993 Hughes
5,277,146 A 1/1994 Hughes, Jr.
5,340,065 A * 8/1994 Thomas ..... G09F 7/205 40/607.04
5,439,311 A 8/1995 Hughes, Jr.
5,452,965 A 9/1995 Hughes, Sr.
5,454,665 A 10/1995 Hughes, Sr.
5,509,231 A 4/1996 Marcoux
5,599,132 A 2/1997 Hughes, Jr.
6,109,820 A 8/2000 Hughes, Sr.
6,540,196 B1 4/2003 Ellsworth
6,604,485 B1 8/2003 Hughes, Sr. et al.
(Continued)

FOREIGN PATENT DOCUMENTS

GB 2126271 A * 3/1984 ..... E01F 9/669

*Primary Examiner* — Gary S Hartmann

(57) ABSTRACT

A safe zone post assembly for supporting delineators or signage installed within a curb safe zone along the vertical wall of the median or curb at a location between the surface of the roadway, or the gutter, up to a location where a vehicle tire contacts the median or curb during impact. Securing the post assembly anchor bolt and base attachments along the vertical wall substantially within the curb safe zone, provides additional protection from vehicle impacts for the base of the post assembly. A post supporting the delineator or signage is secured within the post assembly.

3 Claims, 8 Drawing Sheets

(56) References Cited

U.S. PATENT DOCUMENTS

| | | | | |
|---|---|---|---|---|
| 6,732,673 | B2 | 5/2004 | Hughes, Sr. et al. | |
| 7,003,919 | B2 | 2/2006 | Riker | |
| 7,077,599 | B1 | 7/2006 | Hughes, Jr. | |
| 7,249,910 | B2 | 7/2007 | Eckert et al. | |
| 7,553,103 | B2 | 6/2009 | Jameson et al. | |
| 7,722,286 | B2 | 5/2010 | Heald | |
| 7,819,605 | B2 | 10/2010 | Heald | |
| 7,849,617 | B2 | 12/2010 | Intagliata et al. | |
| 7,955,023 | B2 | 6/2011 | Sung et al. | |
| 8,202,020 | B2 | 6/2012 | Hughes, Jr. | |
| 8,278,398 | B2 | 10/2012 | Lutz et al. | |
| 8,348,545 | B1 | 1/2013 | Hughes, Jr. | |
| 8,734,047 | B2 | 5/2014 | Hughes, Jr. | |
| 9,528,231 | B2 | 12/2016 | Hughes, Jr. | |
| 10,428,475 | B2 | 10/2019 | Weseman et al. | |
| 10,717,831 | B2 | 7/2020 | Oka et al. | |
| 11,466,414 | B2 | 10/2022 | Hughes, Jr. | |
| 11,767,649 | B1 | 9/2023 | Hughes, Jr. et al. | |
| 2001/0045675 | A1 | 11/2001 | Attar | |
| 2006/0218835 | A1* | 10/2006 | Chafin ..... | G09F 21/04 40/611.05 |
| 2010/0135722 | A1 | 6/2010 | Hughes, Jr. | |
| 2010/0254761 | A1 | 10/2010 | Wheeler, Jr. | |
| 2013/0046036 | A1 | 2/2013 | Lebel et al. | |
| 2013/0174776 | A1 | 7/2013 | Hughes, Jr. | |
| 2015/0352787 | A1 | 12/2015 | Humbert et al. | |
| 2018/0057645 | A1 | 3/2018 | Oka et al. | |
| 2018/0291573 | A1 | 10/2018 | Hughes, Jr. | |
| 2019/0257044 | A1 | 8/2019 | Hughes, Jr. | |

* cited by examiner

SAFE ZONE POST ASSEMBLY

CROSS-REFERENCE TO RELATED APPLICATIONS

The present application claims priority from provisional patent application No. 63/438,299, filed on Jan. 11, 2023, the entire subject matter of which is incorporated herein by reference.

TECHNICAL FIELD

The present application relates to a removable post assembly, and in particular to a post assembly for supporting delineators or signage installed within a curb safe zone, which post assembly includes a reinforced, flexible post for self-righting or ease of replacement after impact.

BACKGROUND

Delineator posts and signage are conventionally installed within a base secured on the top surface of a median or roadside curb in order to advise vehicle drivers of a median cut or other potentially hazardous change in a traffic pattern. Such medians or curbs are typically poured concrete vertically above the surface of the roadway, and which range in height above the roadway from 6 to 7 inches, around 8 to 9 inches where increased pedestrian protection is desired, and as high as between 12 to 24 inches in higher traffic areas, or where plantings are provided within the median. Raising the median or curb provides potential pedestrians with some additional protection, as well as making any delineators or signage more visible to oncoming traffic. Alternatively, some medians are provided with ramped edges to avoid damage to a vehicle during inadvertent impact with the median.

Unfortunately, vehicles unavoidably impacting the median or curb may damage the base as the vehicle undercarriage drags over the base of the post assembly. Under such circumstances, the base may be either damaged or detached from the concrete top surface, or the post may be cut or broken off from the base. While replacing a broken or cut post is inconvenient for road maintenance employees, it is not as expensive and inconvenient as replacement and reattachment of damaged base components to the concrete, which must be either glued, epoxied, or otherwise attached using fasteners that are drilled and secured within the concrete. Repairs to the base may also be time consuming and require dangerous disruptions to traffic patterns. There is a need for an improved post assembly to further avoid and resist damage to a post assembly including the base by a vehicle undercarriage.

SUMMARY

The present post assembly is for supporting delineators or signage installed within a curb safe zone. A curb safe zone has been observed to be formed and may be defined along the vertical wall of the median or curb at a location between the surface of the roadway, or the so called—gutter, up to a location where a vehicle tire contacts the median or curb during impact. The curb safe zone space is substantially triangular in cross-sectional configuration, and is formed by the vertical wall, the surface of the roadway adjacent the vertical wall, and the tire or tire tread surface, which is substantially the surface formed from the location where the tire contacts the roadway and the vertical wall during impact. The zone or safe zone is essentially formed where the vehicle, including undercarriage, and the tire, do not impact the curb. As a result, positioning at least a portion of the post assembly attachments along the vertical wall substantially within the curb safe zone provides additional protection from vehicle impacts for the base of the post assembly.

The additional use of a post assembly having a reinforced, flexible member for self-righting and/or ease of replacement after impact also aids in the rapid repair or replacement of any signage or delineators damaged by vehicle impacts. A spring steel reinforcement placed on the side of the assembly adjacent a location where a vehicle may impact the post assembly, is provided in one embodiment of the reinforced, flexible member. Alternatively, a flexible reinforcement may be formed as part of the signage or delineator.

DETAILED DESCRIPTION

Figure 1:
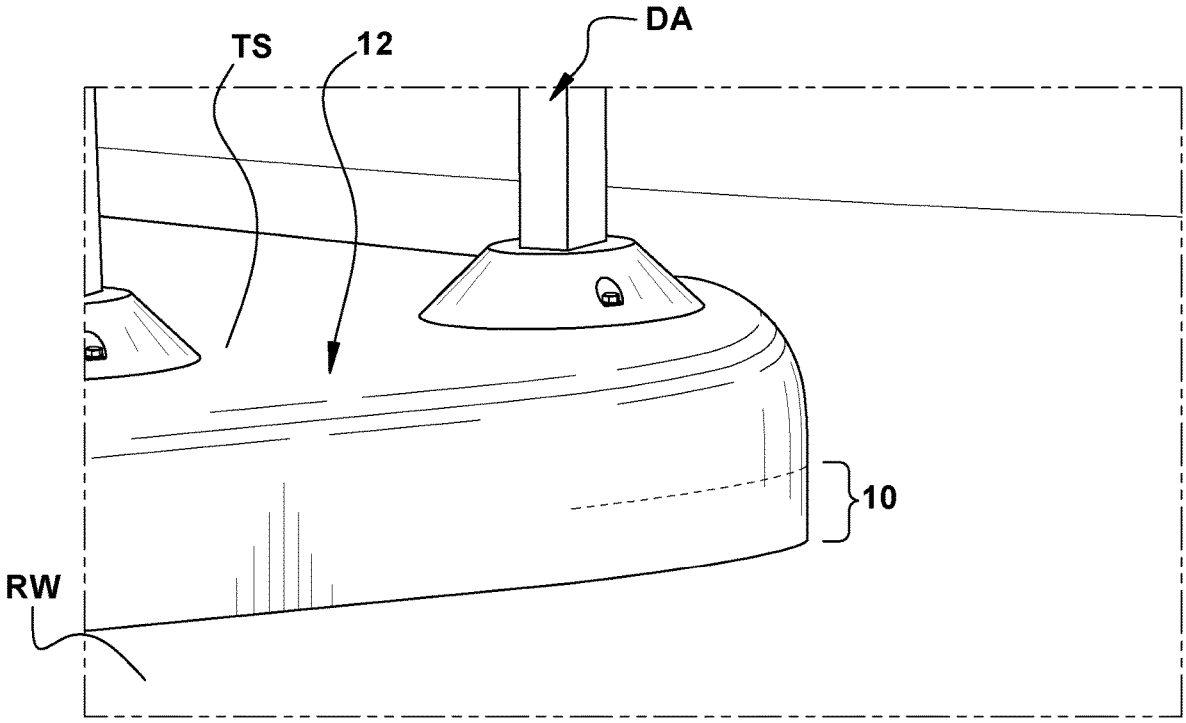
FIG. 1 (Prior Art)
FIG. 1 is a schematic perspective view of a curb along a roadway with a conventional prior art delineator assembly, and showing the curb safe zone location along the curb.
Figure 2:
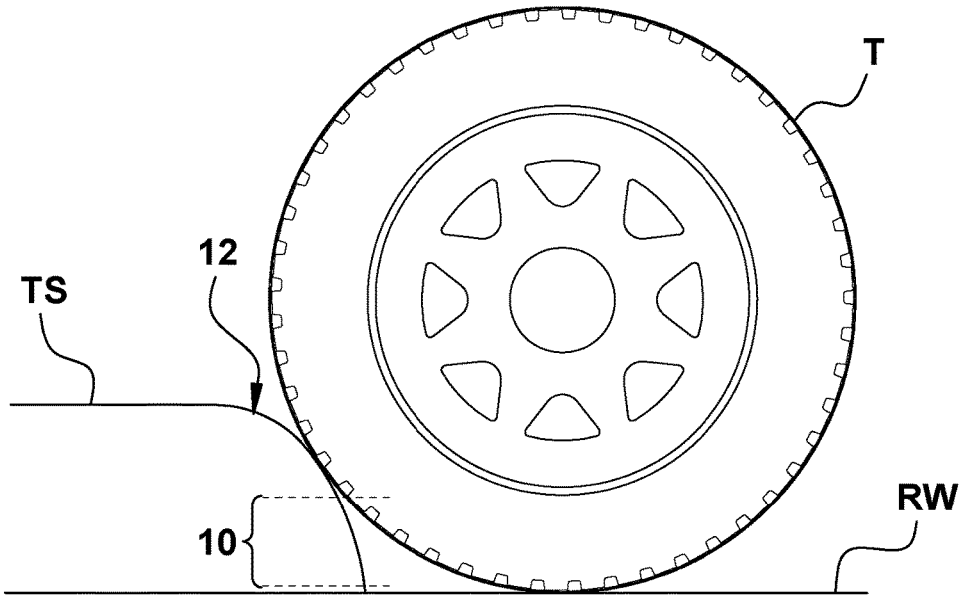
FIG. 2 (Prior Art)
FIG. 2 is a schematic cutaway side view of a vehicle tire impacting a curb and demonstrating the curb safe zone below the point of vehicle tire impact on the curb.

The disclosed embodiments of this application relate to providing a delineator base or post assembly within a curb safe zone 10 location. An example of current locations where prior art delineator post assemblies DA are secured to a roadway is shown in FIG. 1. In FIG. 1, a schematic perspective view of a curb 12 is viewed along a roadway with a conventional prior art delineator assembly DA mounted within a base B secured on a top surface TS or sidewalk adjacent the curb. As shown, the base assembly DA attached at this location along an edge of the curb 12 adjacent the base assembly may be readily damaged by the impact of vehicles to the curb or by impact of a vehicle undercarriage. FIG. 2 shows a schematic cutaway side view of a vehicle tire T impacting a curb 12 and demonstrating the curb safe zone 10 below the point of vehicle tire T impact on the curb. Due to the potential for damage to the base assembly DA at these conventional locations, a safer zone is desired for increased protection of a modified attachment assembly for a delineator base assembly.

Figure 3:
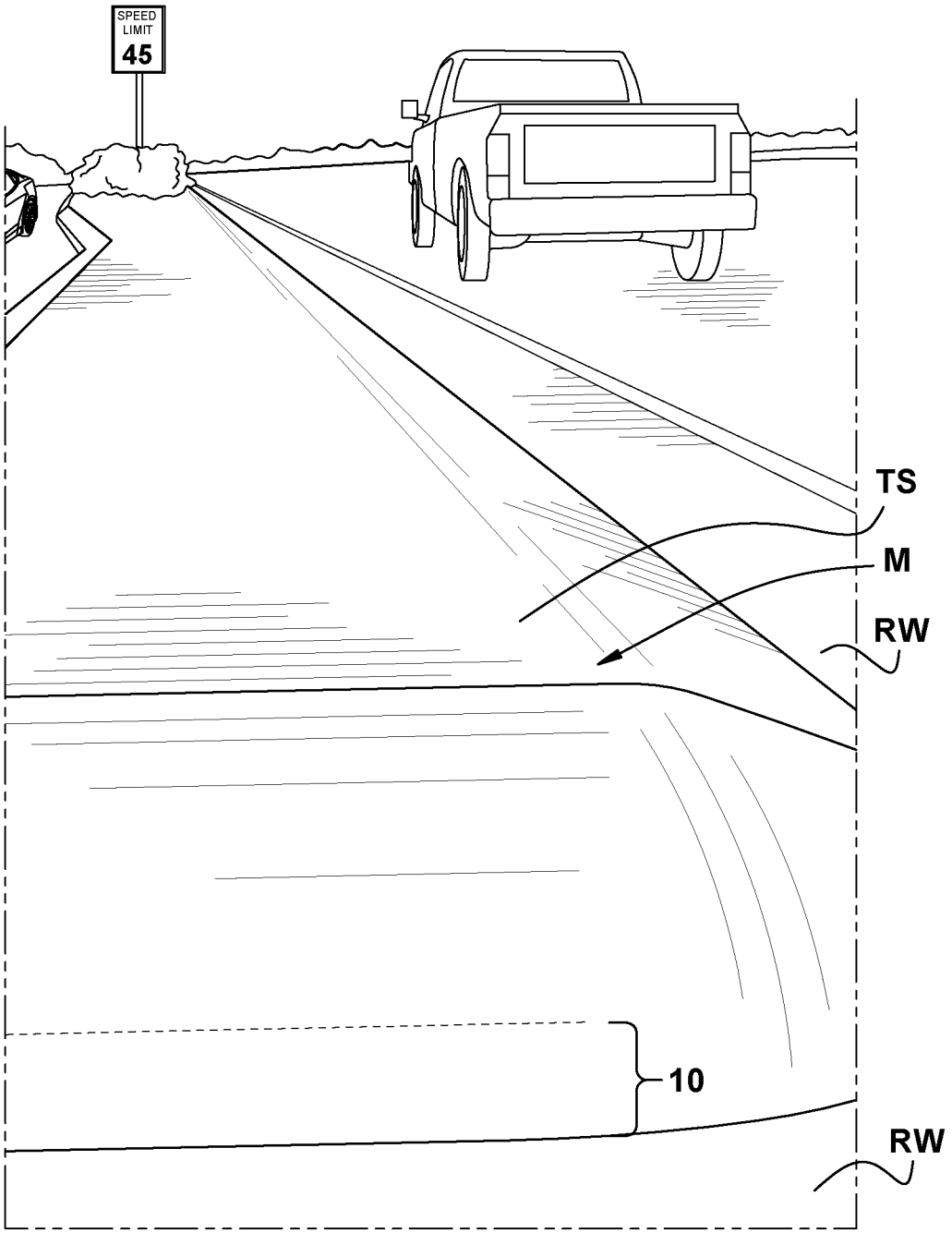
FIG. 3 (Prior Art)
FIG. 3 is a schematic view of a raised median showing the curb safe zone.
Figure 4:
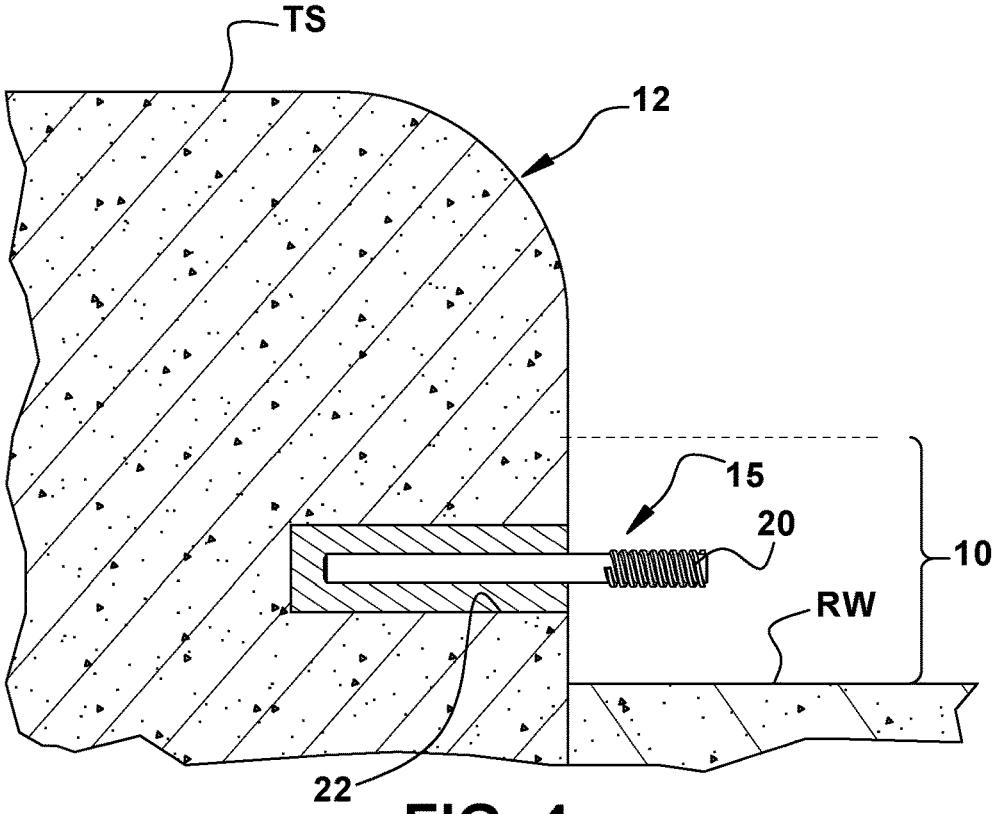
FIG. 4 schematically illustrates a cross-sectional cutaway side view of components of a post assembly for a delineator or roadway signage.
Figure 5:
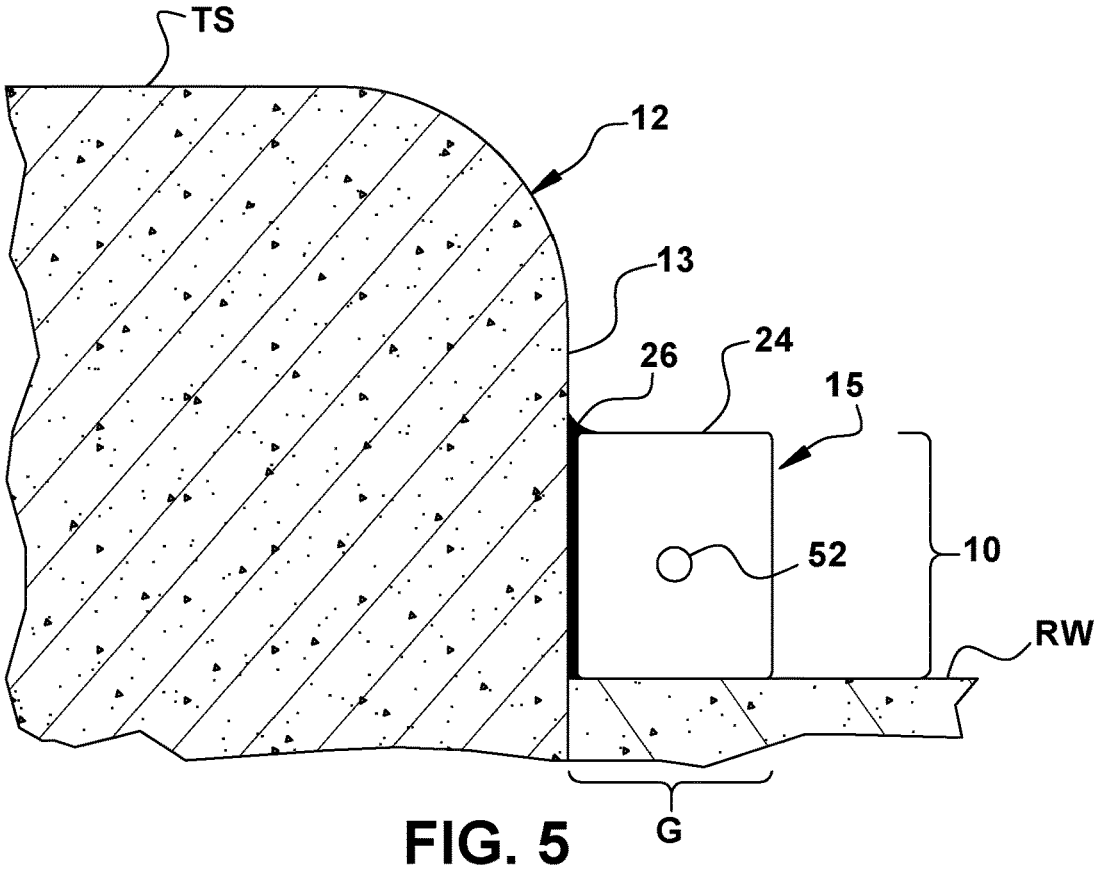
FIG. 5 schematically illustrates a cross-sectional side view of a delineator base of the post assembly of this application.

As shown in FIG. 3, a schematic view of a raised median showing an alternate curb safe zone is illustrated. Likewise, FIG. 4 schematically illustrates a side view of a post or base assembly for a delineator or signage, where a base delineator anchor bolt 20 is secured within a hole 22 drilled to secure the threaded anchor bolt within the curb safe zone 10. Provided at this location, the bolt may be secured within the hole 22 by any conventional means, including cement, epoxy or other adhesives, such that the incidence of impact to the post or base assembly anchor bolt is reduced.

A variety of embodiments of the base post assembly 15 may be attached within the curb safe zone 10. For example, in FIG. 5, a side view of a delineator base 24 of the post assembly has a substantially square configuration, which may be glued 26 or secured anywhere along the vertical wall 13 of the curb safe zone, is provided. In particular, when used within the safe zone, the attachment of the base post assembly may use epoxy and/or any form of mechanical post/nut/bolt or other fastener, such that the post of the post assembly is substantially parallel and spaced with respect to the vertical wall 13 of the curb 12 as shown. As shown in FIGS. 5 to 12, the delineator base 24 may be a hollow, metal sleeve of any cross-sectional configuration for mating engagement with a post 30 having a corresponding cross-sectional configuration. Alternatively, the base may be the end of the post 30 for engagement through aligned holes 28 supported on the anchor bolt. The post 30 may be a single unified member supporting a delineator or signage, or a two-part configuration as in FIGS. 6 and 7.

Figure 6:
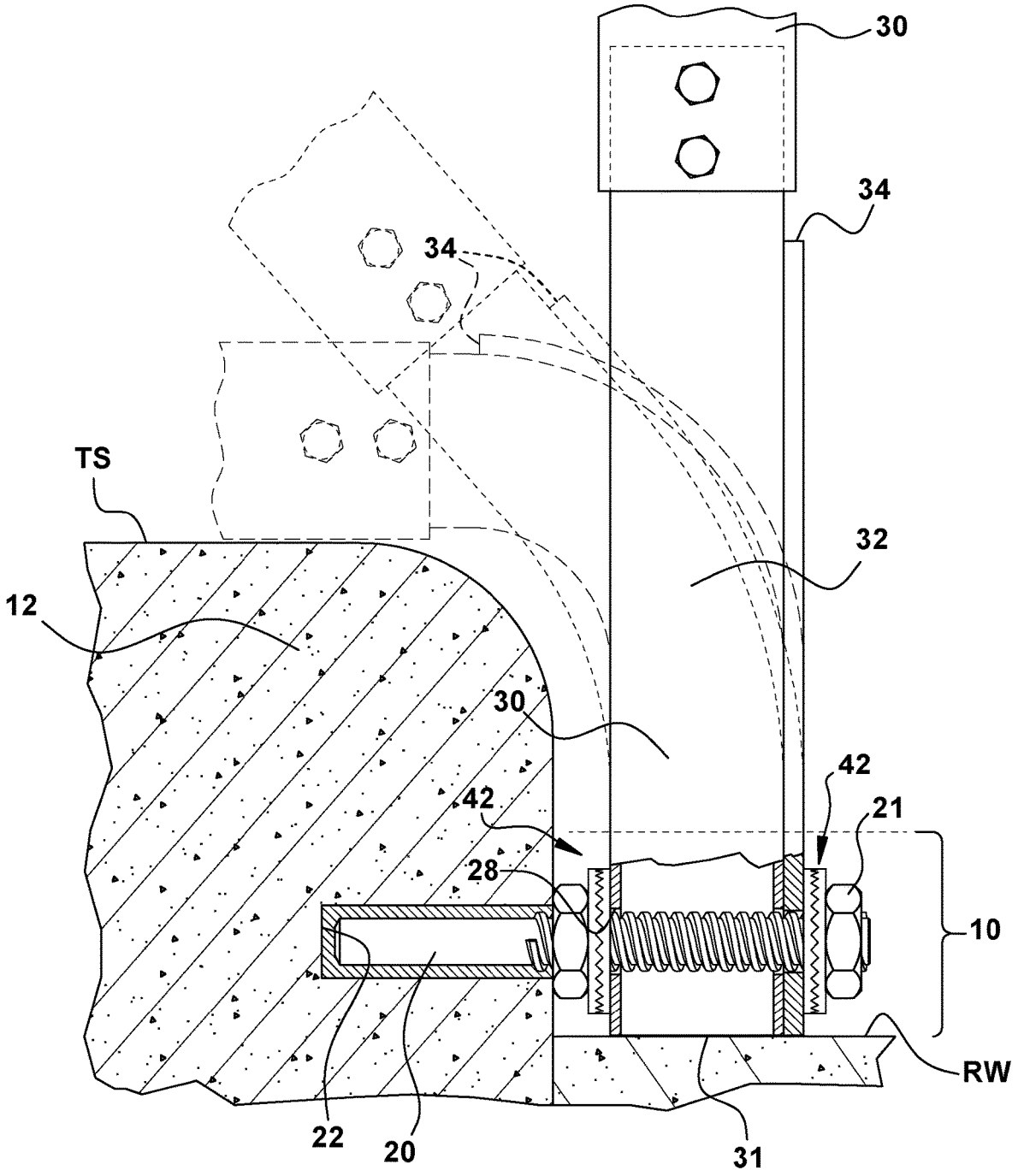
FIG. 6 schematically illustrates a cross-sectional cutaway side view of a delineator base securing a delineator or signage post assembly within the curb safe zone.

In another embodiment, FIG. 6 schematically illustrates a side view of a delineator base securing a delineator or signage post assembly 15 within the curb safe zone 10, where the post assembly is secured using a base anchor bolt 20 with threaded nut members 21, and the post 30 also having a flexible hinge portion 32 adjacent the top surface TS of the curb 12. The flexible hinge portion 32 is shown in a vertically upright position, as well as dashed in a slightly flexed position from a medium vehicle impact, and a still further dashed schematic view of a nearly horizontal post flexed position from a severe vehicle impact. The embodiment of FIG. 6 also shows a protection or reinforcement member 34, preferably of spring steel, secured to the base anchor bolt 20, and at a location for substantially protecting or covering the flexible hinge or hinge portion 32 of the signpost or delineator 30 from vehicles traveling on the roadway RW. The use of the reinforcement member 34 protects the flexible hinge portion 32 from being cut or suffering damage from vehicle undercarriage impact. In particular, the spring steel reinforcement member 34 is primarily provided to be a guard or added layer is provided as a reinforcement member to be a guard or a layer of armor on the impact side of the hinge portion 32 so the undercarriage of the car resists cutting of the hinge. Delineator assemblies may or may not have this feature when initially installed, but may have the reinforcement member 34 added as a replacement following damage. Again, the spring steel reinforcement member 34 provides a guard to protect the hinge 32 from getting cut off when, during vehicle impact, the vehicle undercarriage slides over the top of the reinforcement member 34 and post 30, such that the hinge portion 32 of the post is sandwiched between the curb 12 and the spring steel reinforcement member. As the post 30 and reinforcement member 34 are progressively bent over the curb 12 as shown, protection of the post and/or hinge portion of the post is provided by the reinforcement member. Thus, the spring steel reinforcement member 34 and the flexible hinge portion 32, either independently (as a two-part construction) or together (formed as a one-part member), protect the hinge portion of the post assembly, and enable the delineator—or sign post 30—to flex or move back to its original or more vertical position following a vehicle impact.

Figure 7:
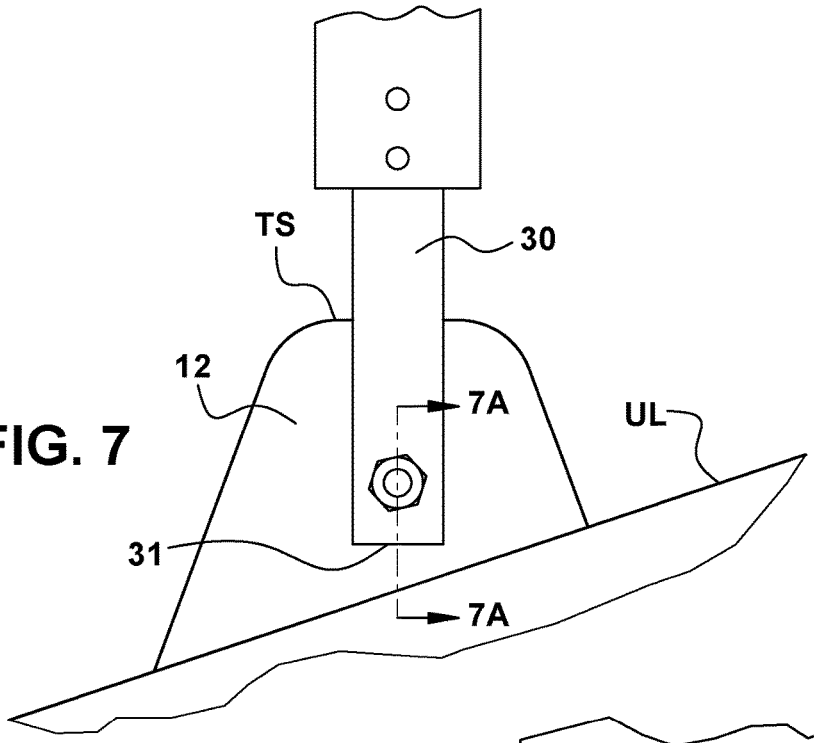
FIG. 7 schematically illustrates an end view of the safe zone curb post assembly on an uneven or unlevel roadway or surface FIG. 7A schematically illustrates an end view of the safe zone curb post assembly on an uneven or unlevel roadway or surface.
Figure 7A:
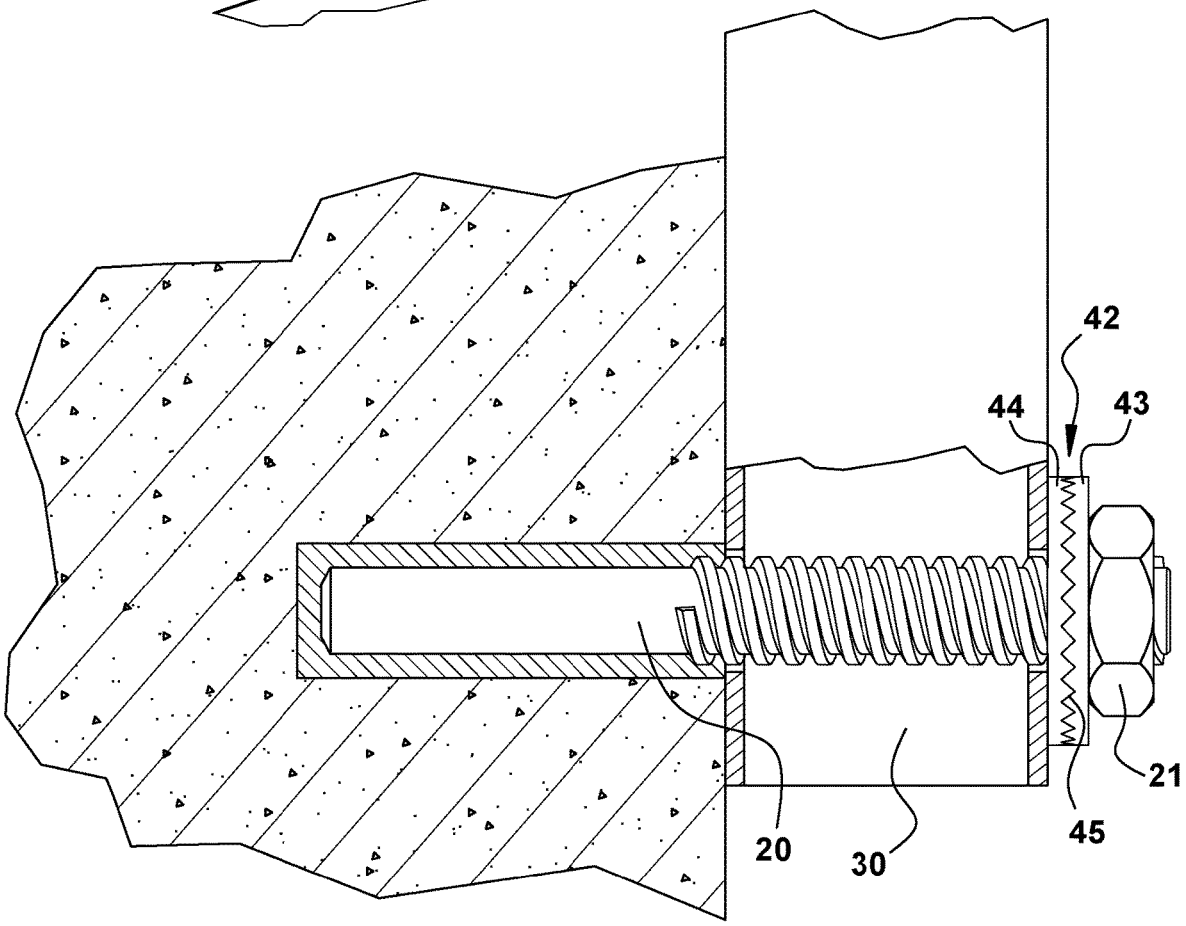

Another embodiment of the safe zone post assembly 15 may also be used on an uneven or unlevel roadway UL. FIGS. 7 and 7A shows the safe zone curb post assembly on such an uneven or unlevel roadway or surface UL. As shown, the post assembly is adjustable at a pivot point 40 with a two-part adjustable lock connection 42. The lock connection enables pivoting or rotating about the pivot point 40 to the desired upright position. The two-part adjustable lock connection 42 is shown as two plates 43, 44 with mating teeth 45 for adjustable (when the plates are first pulled apart) engagement to the desired angle (when reached, the plates and teeth are reengaged together) for alignment of the delineator or signage 30 supported on the post assembly with the unlevel surface UL of the roadway RW. Once adjusted to a position at the desired angle, the lock connection i42 *s* secured in the desired position on the bolt 20 by a locking nut, bolt or other fastener 21, pinching the base and lock connection 42 along the anchor bolt 20 secured to the curb 12 within the curb safe zone 10. A similar two-part lock connection is shown in FIG. 6, but with double two-part lock connections, with one lock connection on each side of the end or base 31 of the post 30 to pinch or capture and lock the post in the desired position.

Figure 8:
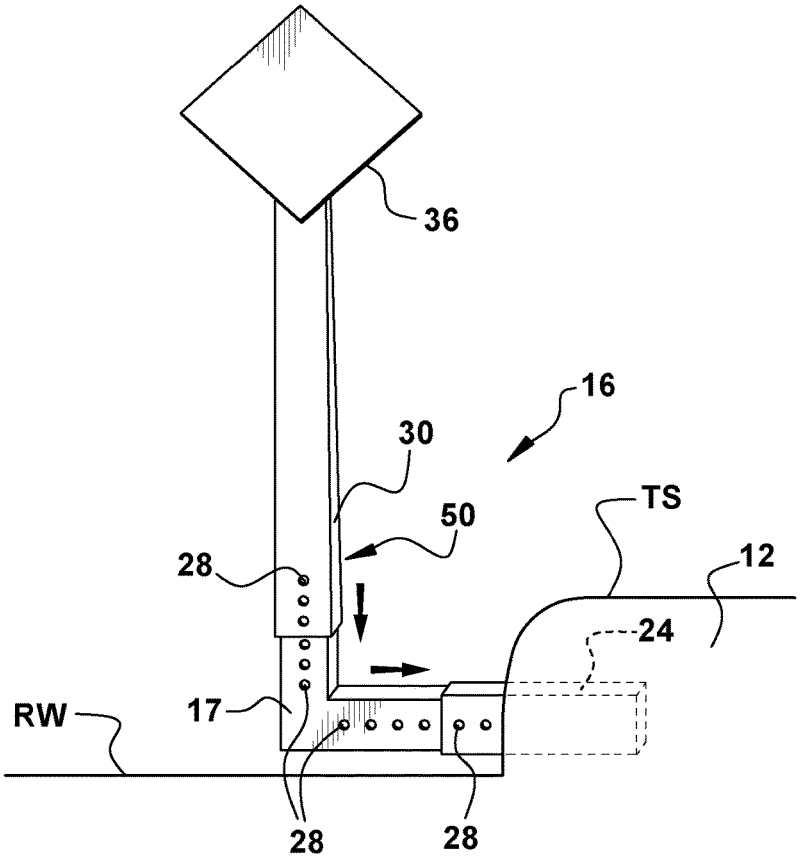
FIG. 8 schematically illustrates an alternate cross-sectional cutaway side view of a base shown just prior to securing a sign to the post assembly within the curb safe zone.

Another alternate embodiment is shown in FIG. 8, where a side view of a base 24 is shown just prior to securing a sign to the post assembly 15 within the curb safe zone 10. As shown, a thicker steel base or sleeve 24 (having a square cross-section, but any cross-sectional shape mating with the end 31 of the post would be possible) is secured within the concrete curb 12. A two-part post assembly 16 having a corner member 17 for slidable horizontal engagement into the base or sleeve 24, and a sign (or delineator) post 30 for vertical engagement into the corner member 17 are provided. The two-part post assembly 16 enables a break away point 50 in the event of vehicle impact. Alignment holes 28 are provided on at least 2 opposite sides of the base or sleeve 24, the two ends of the corner member 17 and the signpost 30. Once the alignment holes 28 within the base 24 and corner member 17 are aligned to the desired position, attachment pins 52 are engaged through and within the alignment holes 28 to secure the components of the post assembly into the desired position.

Figure 9:
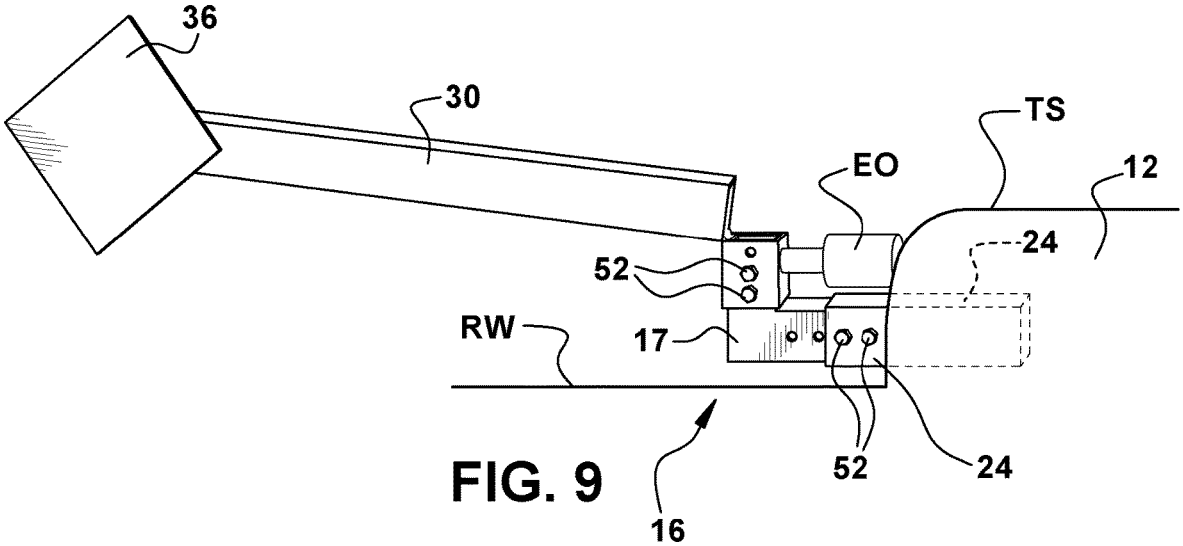
FIG. 9 schematically illustrates the post assembly embodiment of FIG. 8 after a vehicle impact resulting in a break of the signpost at the break away point.

In the illustration of FIG. 9, the alternate post assembly 16 embodiment of FIG. 8 is shown after a vehicle impact has resulted in a break of the post at the break away point 50. The use of this post assembly embodiment enables the post 30 to be readily removed, either together with or separate from the corner member 17, using a pry bar, jack or other conventional easy-out tool EO. Following removal of the broken aspects of the post assembly 16, replacement components may be provided without the need to replace the base or sleeve 24 engaged within the curb safe zone 10, which remains substantially undamaged when positioned within the curb safe zone.

Figure 10:
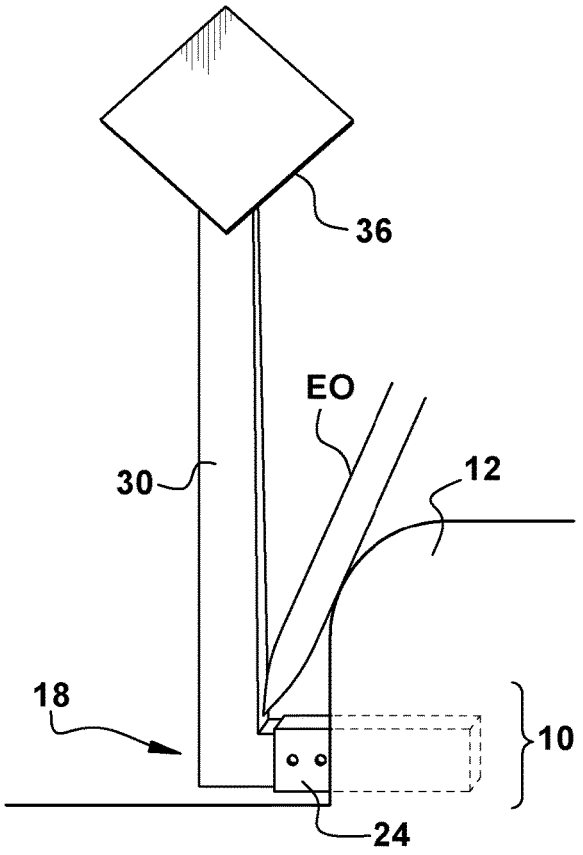
FIG. 10 schematically illustrates an alternate configuration of a one piece sign and post assembly secured within the curb safe zone.

An alternate configuration of a one-piece sign and post assembly 18 is shown in FIG. 10 secured within the curb safe zone 10. The one-piece signpost 30 includes a corner for engagement within the base or sleeve 24, and like the embodiments of FIGS. 8 and 9, is readily removable for ease of replacement using a pry bar EO.

Figure 11:
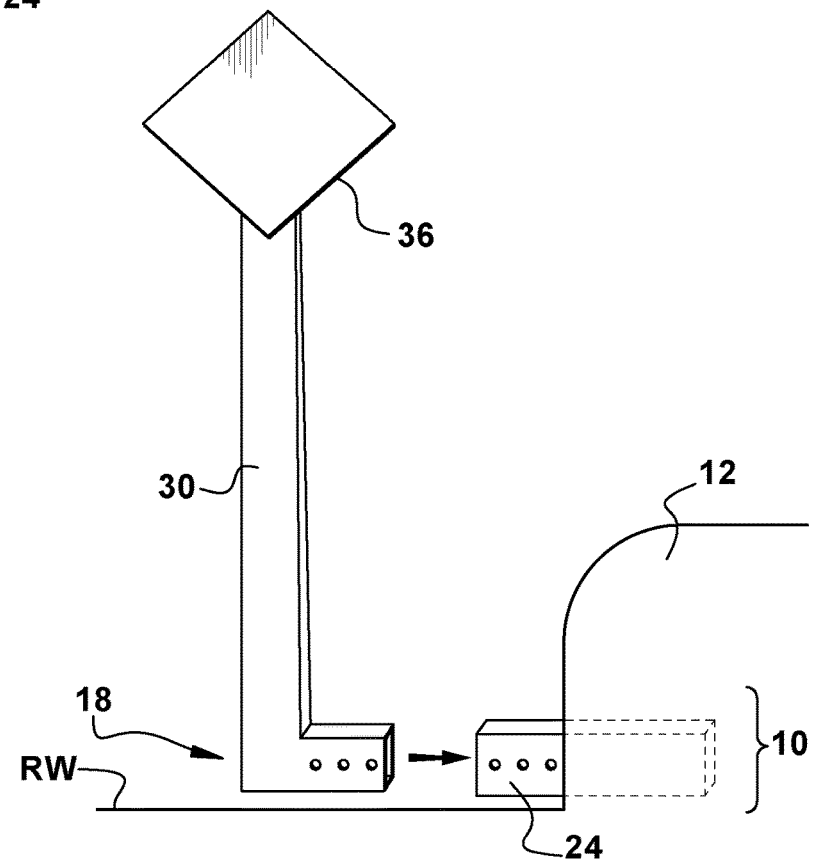
FIG. 11 schematically illustrates an embodiment as in FIG. 10, but showing that the horizontal base or sleeve secured within the concrete curb safe zone may be of any cross-sectional configuration.

In FIG. 11, an embodiment as in FIG. 10, is shown where the horizontal base or sleeve 24 is secured within the concrete curb safe zone 10, and may be of any cross sectional configuration for mating engagement with the sign or delineator post 30.

Figure 12:
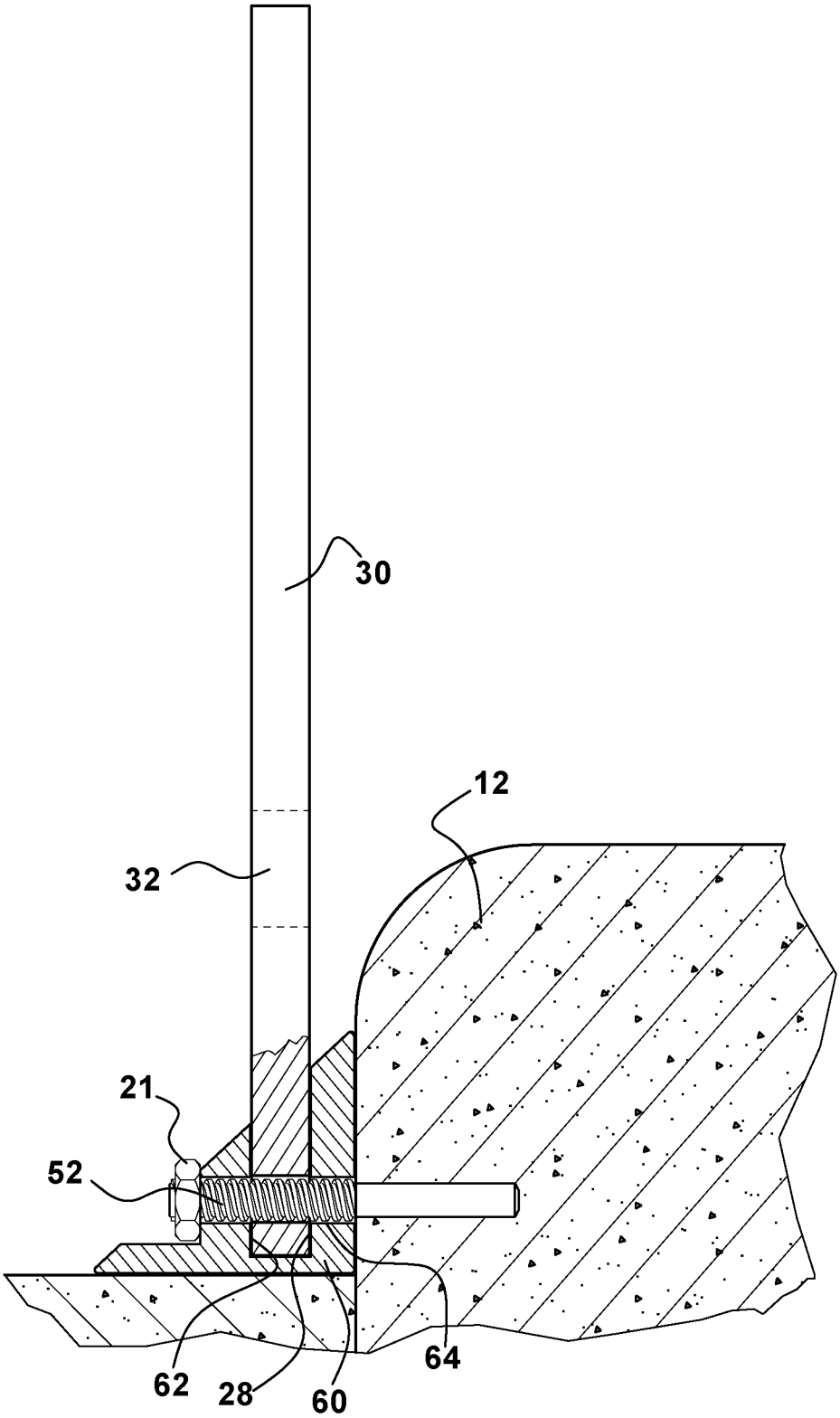
FIG. 12 schematically illustrates still another alternate configuration of the curb safe zone assembly for use with a low curb adjacent the roadway.

Still another alternate configuration for use with a low curb adjacent the roadway is shown in FIG. 12. In this embodiment, a ramp wedge 60 is provided within the gutter G or at the location within the curb safe zone 10 where the curb 12 engages the roadway or surface RW. The ramp wedge 60 is secured to the roadway or curb 12, whether by epoxy, concrete, adhesives or other conventional fasteners, and the sign or delineator post 30 is vertically secured within a mating vertical opening 62 in the ramp wedge 60 using a nut 21 secured on a pin, bolt or fastener 52 engaged horizontally through the openings 64, 28 in the wedge, the sign or delineator post 30, and potentially into the low curb, as shown. The sign or delineator post 30 is provided with a flexible hinge portion 32, such that a vehicle impact enables the post to bend or roll down over the curb, as again the ramp wedge 60 within the curb safe zone 10 may remain largely undamaged as vehicle tires T roll over and/or above the ramp wedge 60 and protect the attachment location to the curb 12 within the curb safe zone 10. The flexible hinge portion of the post may be provided as a two-part construction of different materials, or a one-piece, unitary member where the flexible hinge portion is molded, or attached as a separate component member, of a less rigid material, as compared with the material forming the upper portion of the post 30 supporting the delineator or signage.

Although the present assembly has been described with reference to preferred components and embodiments, those skilled in the art will recognize that changes may be made in form and detail without departing from the spirit and scope intended. As such, it is intended that the foregoing detailed description be regarded as illustrative rather than limiting and that it is the appended claims, including all equivalents thereof, which are intended to define the scope of the present assembly.

I claim:

1. A post assembly having a base member with a horizontal portion secured within and to a vertical wall of a curb, said base member having a vertical portion extending vertically upward from the horizontal portion in a direction parallel with the vertical wall of the curb and spaced from the vertical wall of the curb, and a vertical post for slidable mating engagement within the vertical portion of the base member, said vertical post supporting a delineator member or signage, and secured within the base member by a pin aligned within and through holes aligned on each of the vertical portion of the base member and the vertical post.

2. The post assembly of claim 1, wherein the vertical post of the post assembly is substantially flexible and includes a hinged portion and a spring steel reinforcement or protection member positioned on or adjacent to a side of the vertical post away from the vertical wall of the curb.

3. A method for securing and replacing a post base assembly within a curb safe zone comprising the steps of:

securing a post assembly within a curb safe zone, the post assembly having a base member with a horizontal portion secured within and to a vertical wall of a curb, wherein the base member has a vertical portion having alignment holes, and the base member extends vertically upward from the horizontal portion in a direction parallel with the vertical wall of the curb and spaced from the vertical wall of the curb, engaging a vertical post having alignment holes into mating engagement within the vertical portion of the base member, positioning a delineator member or signage on the vertical post, securing the delineator member or signage to the base member by engaging a pin aligned within and through the alignment holes on each of the vertical portion of the base member and the vertical post; and replacing the delineator member or signage and/or vertical post following a vehicle impact damaging the delineator member or signage and/or vertical post.

* * * * *